US012091237B2

(12) United States Patent
Vallee et al.

(10) Patent No.: US 12,091,237 B2
(45) Date of Patent: Sep. 17, 2024

(54) FLOATING ROOF ADJUSTABLE DECK POSITIONERS

(71) Applicant: Sandborn Roof Inc., Nisku (CA)

(72) Inventors: Dave Vallee, Nisku (CA); Elias Lopez, Nisku (CA)

( * ) Notice: Subject to any disclaimer, the term of this patent is extended or adjusted under 35 U.S.C. 154(b) by 6 days.

(21) Appl. No.: 18/083,003

(22) Filed: Dec. 16, 2022

(65) Prior Publication Data

US 2023/0202748 A1 Jun. 29, 2023

Related U.S. Application Data

(60) Provisional application No. 63/293,449, filed on Dec. 23, 2021.

(51) Int. Cl.
*B65D 88/36* (2006.01)

(52) U.S. Cl.
CPC ..... *B65D 88/36* (2013.01)

(58) Field of Classification Search
CPC ..... B65D 88/36; B65D 88/34; B65D 88/38; B65D 88/40; B65D 88/42; B65D 88/44; B65D 88/46; B65D 88/48; B65D 88/50
See application file for complete search history.

(56) References Cited

U.S. PATENT DOCUMENTS

| | | | | | |
|---|---|---|---|---|---|
| 5,029,932 | A * | 7/1991 | Parr | B60J 7/143 | 296/108 |
| 5,321,881 | A * | 6/1994 | Lippiello | B65D 88/46 | 29/525.04 |
| 5,529,200 | A * | 6/1996 | Ford | B65D 88/46 | 220/226 |
| 6,164,479 | A * | 12/2000 | Kern | B65D 88/46 | 220/216 |
| 9,555,959 | B1 * | 1/2017 | Ziegs | B65D 88/005 | |
| 2014/0061204 | A1 * | 3/2014 | Ziegs | B65D 90/028 | 29/592 |
| 2016/0031637 | A1 * | 2/2016 | Bretherton | B65D 88/46 | 220/222 |
| 2017/0121103 | A1 * | 5/2017 | Ellis | B65D 88/42 | |
| 2020/0024068 | A1 * | 1/2020 | MacLeod | E04G 1/34 | |
| 2021/0080310 | A1 * | 3/2021 | Frövik | B65D 90/48 | |

* cited by examiner

*Primary Examiner* — Kareen K Thomas
(74) *Attorney, Agent, or Firm* — Bennett Jones LLP

(57) ABSTRACT

An adjustable deck positioner includes a vertical member having means for attaching to a deck rim and having a pivot arm bracket; a pivot arm assembly having a pivot arm attached to the pivot arm bracket, wherein the pivot arm may pivot between a substantially vertical position within the pivot arm bracket and an extended position angled away from the vertical member; and a lock pin installed across the pivot arm bracket, for constraining movement of the pivot arm towards the vertical member, thereby setting the angle at which the pivot arm extends from the vertical member.

6 Claims, 3 Drawing Sheets

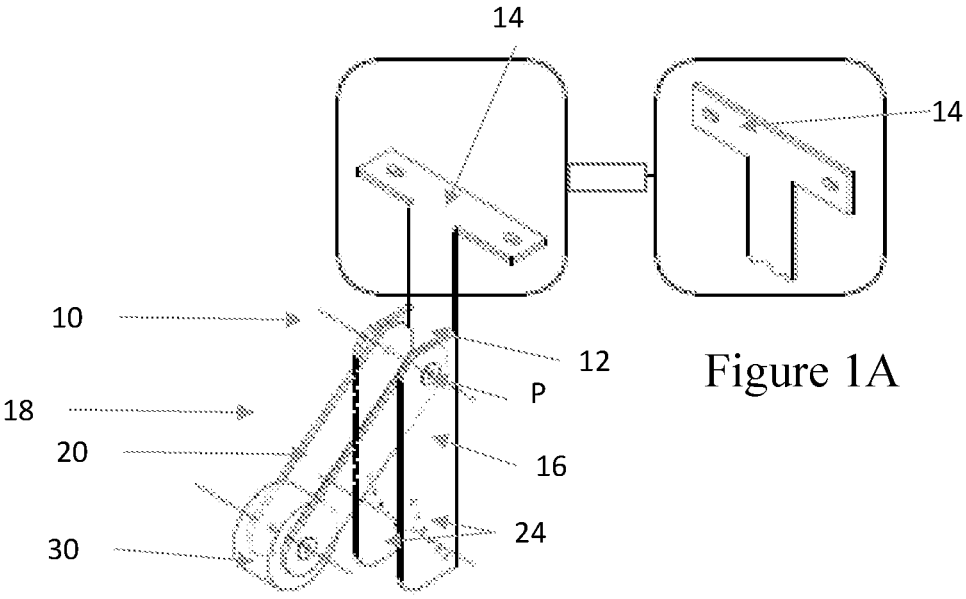
Figure 1A
Figure 1
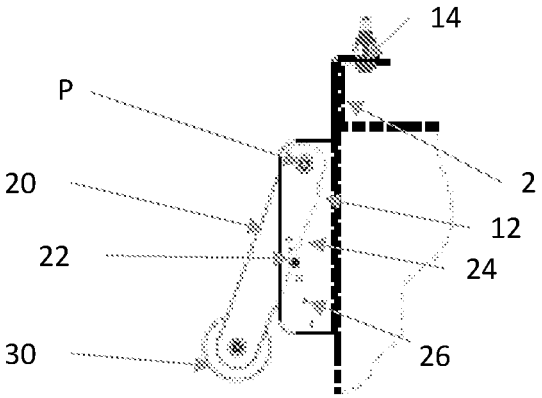
Figure 2

FLOATING ROOF ADJUSTABLE DECK POSITIONERS

FIELD OF THE INVENTION

The present invention relates to an adjustable deck positioning system for a floating roof.

BACKGROUND OF THE INVENTION

Field erected storage tanks are commonly used to store large quantities of petrochemicals including both refined and unrefined products. The tank has a cylindrical steel shell and a roof that floats on the surface of the stored liquid, which reduces emissions and evaporative product loss. The roof rises and falls with the liquid level in the tank. There is a rim seal system between the tank shell and floating roof to reduce rim evaporation.

The floating roof deck typically will include deck positioners which maintain a separation distance between the deck and the inside wall of the storage tank. This gap allows the primary and secondary seals to work properly as the floating roof deck travels vertically within the tank. Installation of the positioners typically involved drilling, welding and/or bolting a series of "spacers", set at a fixed distance. Re-work or replacement would be required should the fixed distance need adjusting or the positioners require a location change.

There is a need in the art for a deck positioner which may mitigate difficulties presented by the prior art.

SUMMARY OF THE INVENTION

In summary, embodiments of the present invention allows for quick and simple adjustments to adjust the deck/tank gap distance as required by tank/seal conditions and/or desired configurations. Furthermore, embodiments of the invention provide a bolted design which allows for quick removal and repositioning.

In one aspect, the invention comprises an adjustable deck positioner comprising (a) a vertical member having means for attaching to a deck rim and having a pivot arm bracket; (b) a pivot arm assembly having a pivot arm attached to the pivot arm bracket, wherein the pivot arm may pivot between a substantially vertical position within the pivot arm bracket and an extended position angled away from the vertical member; and a lock pin installed across the pivot arm bracket, for constraining movement of the pivot arm towards the vertical member, thereby setting the angle at which the pivot arm extends from the vertical member.

In some embodiments, the pivot arm bracket is U-shaped, defining a channel between opposing fins which define a plurality of pairs of vertically spaced lock pin openings. The lock pin is inserted horizontally into a pair of lock pin openings, thus maintaining the pivot arm at an angle away from the vertical member.

The pivot arm assembly has a tank engaging element which may comprise a low-friction material or a wheel, which preferably comprises a low-friction material.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

FIG. 1 shows a perspective view of an embodiment of an adjustable deck positioner having a horizontal attachment flange. FIG. 1A shows an alternative vertical attachment flange.

FIG. 2 shows a side plan view of the embodiment of FIG. 1.

DETAILED DESCRIPTION OF EMBODIMENTS OF THE INVENTION

Figure 3:
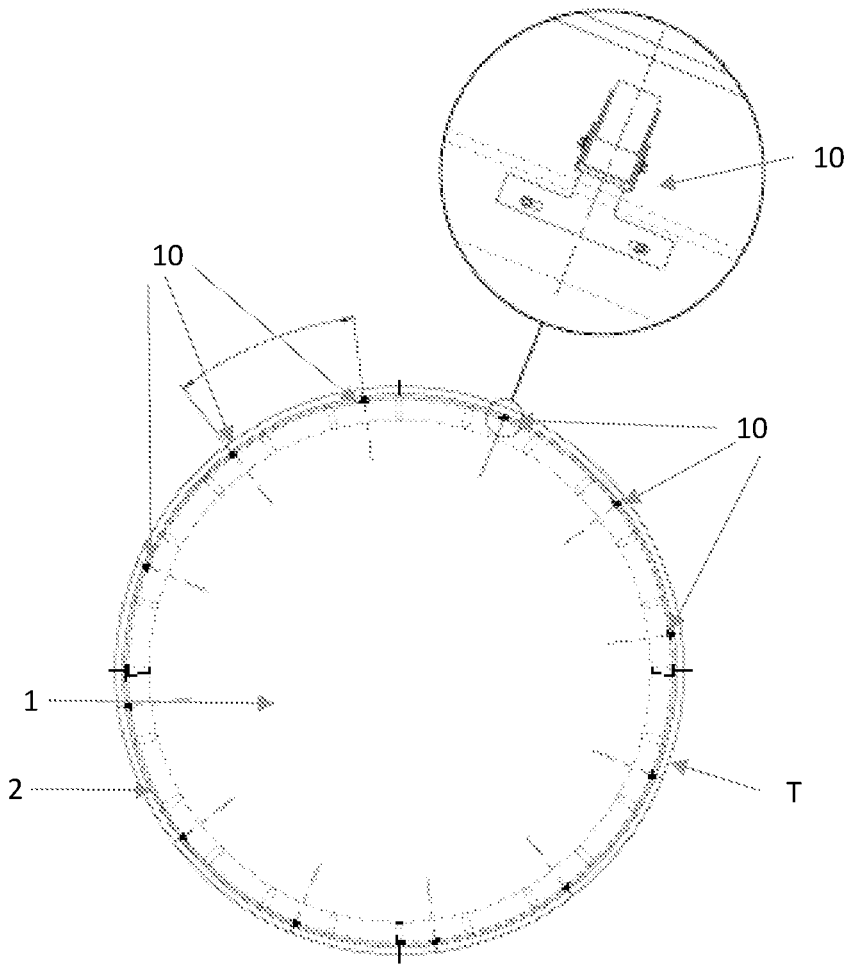
FIG. 3 shows a top plan view of a floating roof deck, with a detailed top plan view of the embodiment of FIG. 1.

The invention relates to an adjustable deck positioning system for a floating roof tank (T). The tank is typically cylindrical with a substantially circular horizontal cross-section. The floating roof is thus a substantially circular member that moves upwards and downwards within the storage tank. The deck (1) is the primary structural element of a floating roof, closely fitting within the storage tank, and includes pontoons, as is well known in the art. The configuration of sealing systems and the floating roof are not essential elements of the present invention.

FIGS. 1 and 2 show an exemplary embodiment of an adjustable deck positioner (10), which comprises:

(a) a vertical member (12) having means for attaching (14) to a deck rim (2) and having a pivot arm bracket (16);

(b) a pivot arm assembly (18) having a pivot arm (20) pivotably attached to the pivot arm bracket (16), wherein the pivot arm is moveable between a substantially vertical position within the pivot arm bracket, and an extended position extending away from the vertical member; and (c) a lock pin (22) installed across the pivot arm bracket, for constraining movement of the pivot arm towards the vertical member, thereby setting the angle at which the pivot arm extends from the vertical member.

In some embodiments, the means for attaching to a deck may comprise an attachment flange (14) which bolts to a deck rim (2), as shown in FIG. 2. In alternative embodiments, the attachment flange (14) may be vertical, as shown in FIG. 1A. Any physical attachment structure may be suitable. It is preferred that the deck positioner (10) be removably attached, permitting convenient removal and repositioning.

In some embodiments, the pivot arm bracket (16) is U-shaped, defining a channel between opposing fins (24) which define a plurality of vertically spaced lock pin openings (26). The embodiment shown in FIG. 2 has six pairs of lock pin openings (26), and the lock pin (22) is inserted in the openings (26) third from the top. The lock pin (22) when inserted horizontally into the lock pin openings will maintain the pivot arm at an angle away from the vertical member, as may be seen in FIG. 2. As the lock pin opening gets closer to the pivot axis (P) of the pivot arm, it will maintain the pivot arm in a more extended position (more horizontal).

The pivot arm assembly (18) has a tank engaging element (30) contacts the inner surface of the tank and moves upwards and downwards with the deck (1). The tank engaging element (30) preferably comprises a low-friction material, such as a smooth plastic, eg. nylon or a PTFE material.

The tank engaging element more preferably comprises a roller wheel (30), which itself may comprise a low-friction material.

As shown in FIG. 3, the adjustable deck positioners (10) are arrayed around the circumference of the deck (1) at predefined locations. The number and spacing of deck positioners may be varied as necessary or desired to meet design parameters. The exemplary embodiment shown in FIG. 3 has 12 deck positioners spaced apart at 30° intervals.

In some embodiments, the deck rim (2) has pre-drilled or formed bolt openings, and the adjustable deck positioners may be bolted to the deck rim with removable fasteners. Thus, the adjustable deck positioners may be removed and repositioned by simply unbolting and bolting in the new desired position.

Figure 4:
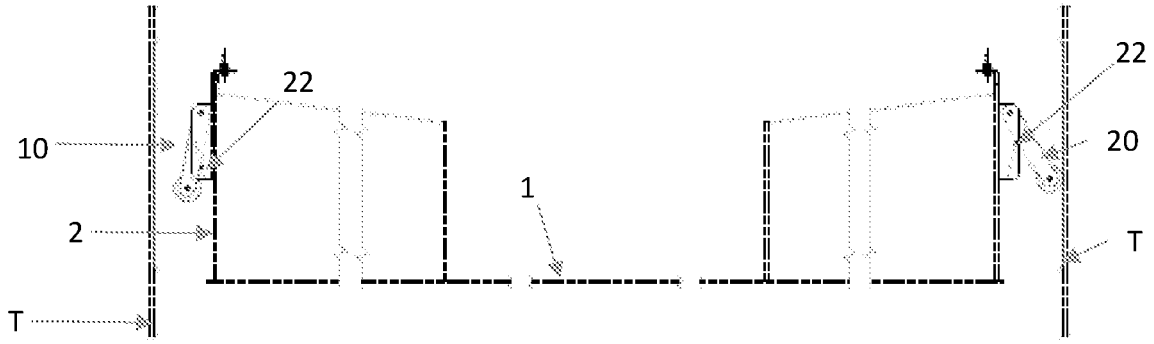
FIG. 4 shows a side cross-sectional view of the floating roof deck of FIG. 3.

As may be seen in FIG. 4, the adjustable deck positioners (10) will act to maintain a gap between the deck edge and the inner surface of the tank (T). The deck positioner shown in the right hand side has the lock pin (22) inserted into the uppermost pair of lock pin openings, thereby extending the pivot arm (20) to its most extended position. The deck positioner shown in the left hand side has the lock pin (22) inserted into the 2' lowermost pair of lock pin openings, thereby extending the pivot arm (20) in a more retracted position.

Interpretation.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. An adjustable deck positioner for a floating roof tank comprising:

(a) a vertical member having means for attaching to a deck rim and having a pivot arm bracket;

(b) a pivot arm assembly having a pivot arm attached to the pivot arm bracket, wherein the pivot arm pivots between a substantially vertical position within the pivot arm bracket and an extended position angled away from the vertical member; and (c) a lock pin installed across the pivot arm bracket, for constraining movement of the pivot arm towards the vertical member, thereby setting the angle at which the pivot arm extends from the vertical member.

2. The adjustable deck positioner of claim 1 wherein the means for attaching to a deck rim comprises a horizontal or vertical flange bolted to the deck rim.

3. The adjustable deck positioner of claim 1 wherein the pivot arm bracket comprises a U-shaped channel formed between opposing fins which define a plurality of vertically spaced lock pin openings.

4. The adjustable deck positioner of claim 1 wherein the pivot arm comprises a tank engaging element.

5. The adjustable deck positioner of claim 4 wherein the tank engaging element comprises a low-friction material or a roller wheel.

6. A floating roof deck having a plurality of adjustable deck positioners as claimed in claim 1 installed around its circumference.

* * * * *